US007651230B2

(12) United States Patent
O'Neill

(10) Patent No.: US 7,651,230 B2
(45) Date of Patent: Jan. 26, 2010

(54) APPARATUS FOR PRODUCING AN OPTICAL EFFECT OR FOR SIMULATING FIRES AND SIMULATED FIREPLACES INCLUDING SUCH APPARATUS

(75) Inventor: Noel O'Neill, Drogheda (IE)

(73) Assignee: Basic Holdings, Dublin (IE)

( * ) Notice: Subject to any disclaimer, the term of this patent is extended or adjusted under 35 U.S.C. 154(b) by 14 days.

(21) Appl. No.: 11/577,288

(22) PCT Filed: Oct. 13, 2005

(86) PCT No.: PCT/EP2005/011044

§ 371 (c)(1),
(2), (4) Date: Apr. 13, 2007

(87) PCT Pub. No.: WO2006/040167

PCT Pub. Date: Apr. 20, 2006

(65) Prior Publication Data

US 2008/0037254 A1 Feb. 14, 2008

(30) Foreign Application Priority Data

Oct. 13, 2004 (GB) ..... 0422717.9

(51) Int. Cl.
*G09F 13/22* (2006.01)

(52) U.S. Cl. ..... 362/84; 362/810

(58) Field of Classification Search ..... 362/84, 362/806, 810, 811, 458, 96, 234, 253, 569; 40/428, 431

See application file for complete search history.

(56) References Cited

U.S. PATENT DOCUMENTS 1,432,942 A 10/1922 Zei et al.
1,827,941 A 10/1931 Gross
3,395,476 A 8/1968 Moss et al.
4,965,707 A * 10/1990 Butterfield ..... 362/96
5,572,817 A * 11/1996 Chien ..... 40/544
5,612,266 A 3/1997 Delvaux et al.
5,642,580 A * 7/1997 Hess et al. ..... 40/428

(Continued)

FOREIGN PATENT DOCUMENTS

CA 2321716 9/1999

(Continued)

OTHER PUBLICATIONS

Search Report for British Application No. GB0403601.8 dated Jun. 29, 2004.

(Continued)

*Primary Examiner*—Jong-Suk (James) Lee
*Assistant Examiner*—Leah S Lovell
(74) *Attorney, Agent, or Firm*—Ryan A. Schneider, Esq.; Troutman Sanders LLP

(57) ABSTRACT

Apparatus for producing an optical effect includes a screen comprising at least one electroluminescent material and associated electrodes for exciting the electroluminescent material to emit light. The electrodes are locally excitable so that the regions of the electroluminescent material generally in the shape of flames may be excited. In an alternative form, or additionally, the screen comprises a material of variable opacity such as a liquid crystal polymer or a suspended particle device gain, electrodes are locally excitable to locally change the opacity of the screen. The screen is locally illuminated to provide the impression of flames.

19 Claims, 5 Drawing Sheets

U.S. PATENT DOCUMENTS

| | | | | |
|---|---|---|---|---|
| 6,551,726 | B1 * | 4/2003 | Burrows | 428/690 |
| 6,688,752 | B2 * | 2/2004 | Moore | 362/234 |
| 6,988,820 | B2 * | 1/2006 | Drufva | 362/559 |
| 2002/0152655 | A1 | 10/2002 | Merrill et al. | |
| 2003/0041491 | A1 | 3/2003 | Mix | |
| 2003/0103021 | A1 | 6/2003 | Young et al. | |
| 2003/0184218 | A1 | 10/2003 | Brost et al. | |
| 2005/0097792 | A1 | 5/2005 | Naden | |

FOREIGN PATENT DOCUMENTS

| | | | |
|---|---|---|---|
| DE | 4142320 | | 7/1992 |
| EP | 0170521 | | 2/1986 |
| EP | 0194157 | | 9/1986 |
| EP | 0897514 | | 6/2002 |
| FR | 2846562 | | 5/2004 |
| GB | 108097 | | 7/1917 |
| GB | 417413 | | 10/1934 |
| GB | 2232481 | | 12/1990 |
| GB | 2232481 | A * | 12/1990 |
| GB | 2242736 | | 10/1991 |
| GB | 2256040 | | 11/1992 |
| GB | 2264555 | | 9/1993 |
| GB | 2322188 | | 8/1998 |
| GB | 2391933 | | 2/2004 |
| GB | 2395131 | | 5/2004 |
| JP | 11162651 | A * | 6/1999 |
| WO | WO 99/45326 | | 9/1999 |
| WO | WO 01/57447 | | 8/2001 |
| WO | WO 02/099338 | | 12/2002 |
| WO | WO 03/063664 | | 8/2003 |
| WO | WO 2006/027272 | | 3/2006 |
| WO | WO 2007/104532 | | 9/2007 |

OTHER PUBLICATIONS

International Search Report for PCT Application No. PCT/EP2005/001668 dated Jul. 5, 2005.

International Search Report for PCT Application No. PCT/EP2005/009776 dated Dec. 16, 2005.

International Search Report and Written Opinion for PCT Application No. PCT/EP2005/009774 dated Jan. 2, 2006.

International Search Report and Written Opinion for PCT Application No. PCT/EP2005/007179 dated Nov. 3, 2006.

Search Report for British Application No. GB0403601.8 dated Oct. 5, 2007.

International Search Report for PCT Application No. PCT/EP2007/002207 dated Dec. 6, 2007.

Examination Report dated Jan. 9, 2009 for related Chinese Patent Application No. 200580042662.4.

* cited by examiner

APPARATUS FOR PRODUCING AN OPTICAL EFFECT OR FOR SIMULATING FIRES AND SIMULATED FIREPLACES INCLUDING SUCH APPARATUS

BENEFIT CLAIMS

This application is a U.S. National Stage of International Application No. PCT/EP2005/011044, filed 13 Oct. 2005, which claims the benefit of GB 0422717.9, filed 13 Oct. 2004.

The present invention relates to apparatus for producing an optical effect, and more particularly to apparatus for simulating fires, especially flames of fires, and to simulated fireplaces including such apparatus.

Simulated fireplaces are well known and established in the marketplace. The realism achieved by such fireplaces in simulating glowing embers and, more especially, flames has reached a high level. However, as always, there is room for improvement. Most simulated fireplaces currently on the market use electro-mechanical means for the simulation of flames. Such known apparatus are typified by that described in GB 2 230 335 which includes a light source, a viewing screen and reflective "flags" mounted behind the viewing screen. The flags are illuminated by the light source and viewed through the viewing screen. The flags are caused to billow in an air flow. The screen is partially diffusing of light, which enhances the appearance of flames caused by the billowing of the illuminated flags. Electro-mechanical devices have at least the potential to be less reliable than might be desired and are also relatively expensive to manufacture. Accordingly, the present invention seeks to provide an alternative means of simulating flames and glowing embers and the like in a fire.

The present invention seeks to fulfill this desideratum by using electroluminescent materials and/or materials of changeable opacity for the simulation of flames.

According to a first aspect of the present invention there is provided an apparatus for producing an optical effect comprising:

a housing;

an electroluminescent screen comprising a supporting substrate, a first electrode layer, a layer comprising at least one electroluminescent material, and a second electrode layer, wherein the first electrode layer is divided into separately excitable segments, each segment causing an adjacent portion of the electroluminescent layer to emit light when said segment is excited; and a control unit for exciting said segments of the first electrode layer in a predetermined, random or pseudo-random sequence.

According to a second aspect of the invention there is provided a simulated flame fire comprising an apparatus according to the first aspect wherein said control means is operative to sequentially to excite segments or groups of segments of said first electrode layer having a shape resembling that of flames.

In one preferred embodiment of this aspect of the invention the simulated flame fire further comprises distinct areas of the electroluminescent material layer which are shaped to be representative of flames, each said area including one or more electroluminescent materials emitting light of flame like colours.

Preferably said simulated flame fire further comprises a simulated fuel bed mounted in said housing directly below said electroluminescent screen.

In one embodiment of the first and second aspects of the invention, preferably a plurality of said electroluminescent screens is provided.

Optionally, one or more light sources are provided, effective to illuminate local areas of the electroluminescent screen.

Preferably said light source or light sources illuminate said electroluminescent screen from the rear.

Preferably said light sources comprise individual LEDs or groups or arrays of LEDs.

According to a third aspect of the invention there is provided an apparatus for producing an o a housing;

a screen including means for providing a variable opacity comprising a supporting substrate, a first electrode layer, a layer of material for providing a variable opacity when subjected to an electric field, and a second electrode layer, wherein the first electrode layer is divided into separately excitable segments, each segment causing an adjacent portion of the layer of material for providing a variable opacity to change its opacity when said segment is excited;

one or more light sources effective to illuminate local areas of the said screen; and a control unit for exciting said segments of the first electrode layer in a predetermined, random or pseudo-random sequence.

According to a fourth aspect of the invention there is provided a simulated flame fire comprising an apparatus according to the third aspect of the invention wherein said control means is operative to sequentially to excite segments or groups of segments of said first electrode layer having a shape resembling that of flames.

In one preferred embodiment of this aspect of the invention the layer of material for providing a variable opacity is divided into distinct areas of predetermined shape.

Preferably said distinct areas of the layer of material for providing a variable opacity are shaped to be representative of flames and wherein said light source or light sources are adapted to provide light of flame-like colours.

Preferably said simulated flame effect fire further comprises a simulated fuel bed mounted in said housing directly below said screen.

Preferably said light source or light sources illuminate said screen from the rear.

Preferably said light sources comprise individual LEDs or groups or arrays of LEDs.

Preferably the means for providing a variable opacity is a liquid crystal polymer (LCP) device or a suspended particle device (SPD).

According to a fifth aspect of the invention there is provided an apparatus for producing an optical effect comprising:

a housing;

a screen comprising a supporting substrate; a first electrode layer; a layer of electroluminescent material; and a second electrode layer; wherein the first electrode layer is divided into separately excitable segments, each segment causing an adjacent portion of the electroluminescent layer to emit light when said segment is excited; a third electrode layer; a layer of material for providing a variable opacity when subjected to an electric field; and a fourth electrode layer, wherein the third electrode layer is divided into separately excitable segments, each segment causing an adjacent portion of the layer of material for providing a variable opacity to change its opacity when said segment is excited; and a control unit for exciting said segments of the first and third electrode layers in a predetermined, random or pseudo-random sequence.

According to a sixth aspect of the invention there is provided a simulated flame fire comprising an apparatus according to the fifth aspect of the invention wherein said control means is operative to sequentially to excite segments or groups of segments of said first electrode layer having a shape resembling that of flames.

In one preferred embodiment, the simulated flame fire of this aspect of the invention comprises distinct areas of the electroluminescent material layer which are shaped to be representative of flames each said area including one or more electroluminescent materials emitting light of flame like colours.

Preferably said control means is operative to sequentially to excite segments or groups of segments of said third electrode layer having a shape resembling that of flames.

Preferably the layer of material for providing a variable opacity is divided into distinct areas of predetermined shape.

Preferably said distinct areas of the layer of material for providing a variable opacity are shaped to be representative of flames.

Preferably the simulated flame effect fire of this aspect further comprises one or more light sources effective to illuminate local areas of said screen.

Preferably said light source or light sources are adapted to provide light of flame-like colours.

Preferably the simulated flame effect fire of this aspect further comprises a simulated fuel bed mounted in said housing directly below said screen.

For a better understanding of the invention and to show how the same may be carried into effect, reference will be made, by way of example only, the following drawings in which.

Electroluminescent materials as such are well known. Electroluminescence is the emission of light by a material when subjected to an electric field. Phosphor electroluminescence was discovered in the early $20^{th}$ century and was initially used in electroluminescent powder lamps, with limited success. The technology was further developed in the 1980s resulting in flexible electroluminescent phosphors which are incorporated as backlights in LCD displays. Such flexible phosphor materials are produced by embedding or encapsulating the phosphor in a matrix, such as of a glass or polymer material, and sandwiching a layer of the resulting powder between two electrodes. Devices incorporating such powder-type phosphors are known as "thick film" or "powder" electroluminescent devices.

So-called "thin film" devices are also known which employ a thin film of an electroluminescent phosphor deposited on a substrate. Thin film technology has been used to make electroluminescent displays, as described, for example, in U.S. Pat. No. 5,463,279.

In addition to inorganic electroluminescent materials noted above, organic electroluminescent materials are also known. A selection of such materials is described in GB 2 394 109, the contents of which are incorporated herein by reference.

The use of light emitting conjugated polymers (LEPs) is also known in electroluminescent devices. Examples of LEPs such as poly(p-phenylenevinyline) are described in WO 90/13148 the contents of which are incorporated herein by reference.

Figure 15:
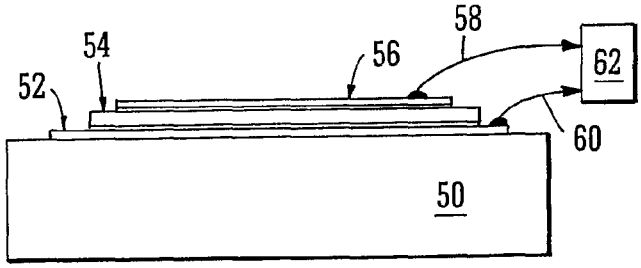
FIG. 15 shows a typical arrangement of an OLED.

Organic electroluminescent materials, and especially polymeric electroluminescent materials are often referred to as OLEDs (either Organic Light Emitting Diodes or Organic Light Emitting Devices). The semi-conducting polymers used in OLEDs are known as PLEDs (Polymer LEDs). The development of OLEDs is progressing rapidly, in particular as a substitute of LCD displays as used, for example, in portable (laptop) computers. Numerous PLEDs which emit light in various different colours are known. OLEDs are advantageous as compared to LCDs in that the OLED polymers are inherently light emitting, allowing a significantly lower power consumption than LCDs, which must be backlit. More information on OLEDs can be found in numerous patent sources, such as the numerous patents of Cambridge Display Technology Ltd. Polymers for OLEDs are available from, for example, H W Sands Corp, Jupiter, Fla., USA. A typical arrangement of an OLED is shown in FIG. 15. The device of FIG. 15 comprises a substrate 50 which is typically a glass substrate, an electrode layer 52 of a material having a relatively large work function, such as indium tin oxide (ITO), a polymer layer (PLED layer) 54 and a further electrode layer 56 of a material of relatively low work function such as calcium. Contacts 58, 60 provide connection to control circuitry 62. Barrier and cover layers for protection of the OLED may, of course also be provided.

The apparatus and simulated flame fire of the present invention can, in principle, employ any of the above technologies.

Figure 1:
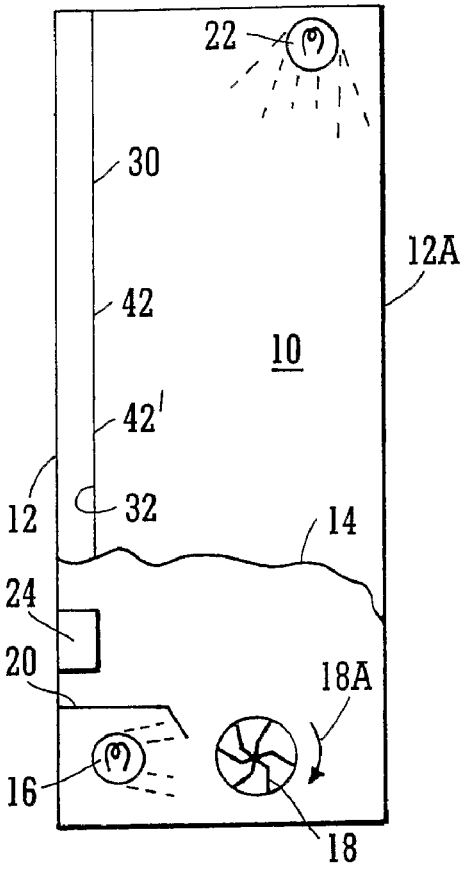
FIG. 1 is a schematic cross-section showing the general arrangement of a fire according to one embodiment of the invention.

Referring now to the drawings, in which FIG. 1 shows in a general, non-limiting, arrangement a simulated fire 10 comprising a housing 12. The housing 12 may be constructed in any desired form to simulate the construction of a real solid fuel fire or stove and may optionally include a transparent front screen or window 12A. In front of the housing 12 is a simulated fuel bed 14. The fuel bed 14 may comprise a moulding formed from a plastic material which is shaped and coloured to resemble pieces of fuel resting on an ember bed. For example, the moulding may represent logs (coloured primarily dark brown) resting on a bed of glowing embers (coloured primarily red and orange). In alternative constructions, the fuel bed may comprise an ember bed formed from a shaped and coloured plastic moulding, with discrete pieces of simulated fuel, such as logs or coals, resting on the ember bed. Fuel bed 14 may be illuminated from below by a light source 16. Light from the light source 16 may be reflected by a device 18 for providing a flicker effect which in the illustrated example is a shaft having generally radial pieces of reflective material. The shaft is rotated about its axis, as indicated by arrow 18A. A baffle 20 may be provided so that light from the light source 16 cannot fall on the fuel bed 14 other than via the flicker device 18. If desired, a light source 22 may be provided for illuminating the fuel bed from above.

For providing the flame effect to simulate the flames of a real fire, the simulated fire 10 is provided with an electroluminescent screen 30. The screen 30 comprises a supporting substrate 32 which is preferably substantially rigid and is fixedly mounted in the housing 12. A suitable supporting substrate can be a glass sheet or a plastic web or sheet. A supporting layer 34 (which may be the same as supporting substrate 32) carries a first electrode layer 36. A layer of electroluminescent material 38 is sandwiched between the first electrode layer 36 and a second electrode layer 40. Typical electrode layers are formed from materials such as indium tin oxide (ITO). A barrier substrate layer 42 is provided to enclose and protect the various layers below. Other layers may be included in the screen, as will be known to those skilled in the art of electroluminescent materials. The barrier substrate and the second electrode layer are necessarily formed from transparent (or at least translucent) materials so that the luminescence of the layer 38 is freely viewable.

Figure 4:
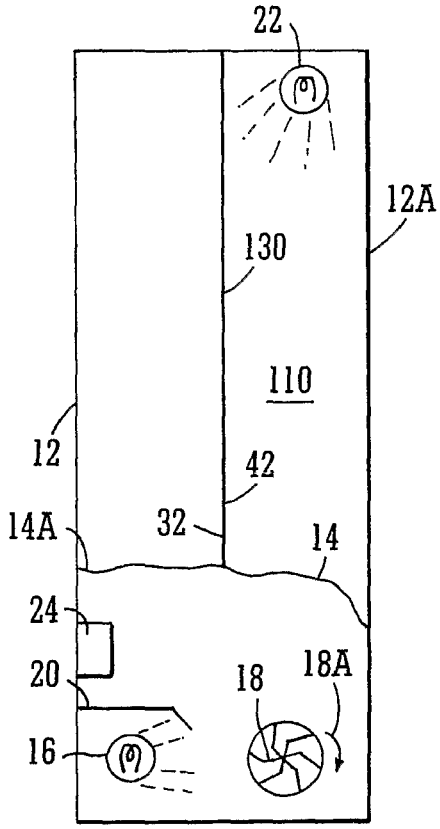
FIG. 4 shows a variation of the embodiment of FIG. 1.

In the embodiment shown in FIG. 1, the first electrode layer 36, supporting substrate 32 and supporting layer 34 need not be transparent since there is no requirement for a user to see through the screen 30. Indeed, it may be desirable for the screen to be opaque so that any components located behind the screen 30 are not visible to a user. To the contrary, as seen in FIG. 4, in an alternative embodiment of a fire or stove 110, a screen 130 (which is otherwise equivalent to screen 30 of FIG. 1) is mounted in the middle of the fuel bed 14. In screen 130, all the component layers are made to be transparent (or at least substantially transparent) so that the portion 14A of the fuel bed 14 lying behind the screen 130 is visible to the user. In this way, the illusion of flames created by the screen 130 appears to come from the middle of the fuel bed 14, providing a more realistic effect. A similar effect can be achieved in the embodiment of FIG. 1 by providing the screen 30 with a partially reflective front surface 42'. In this way, the user sees a reflection of the fuel bed 14 in the front of the screen 30, so that the illusion of flames appears to be located between the fuel bed 14 and its reflection, so giving the appearance of a fuel bed with greater front-to-back depth.

Figure 3:
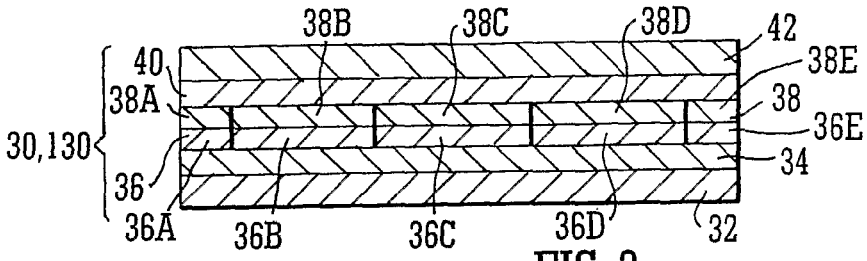
FIG. 3 shows a typical construction of an electroluminescent screen according to the invention.

As may be seen in particular from FIG. 3, the first electrode layer 36 may be divided into discrete segments 36A, 36B, 36C, 36D, 36E, each of which is independently excitable by a control unit or driver 24 mounted in the housing 12 in a location not visible to a user in normal use. The term "excite" is used herein to mean the application of a voltage to a given segment, say 36N, of the first electrode layer 36 sufficient to cause local luminescence of the electroluminescent layer and the terms "excited", "excitation" and the like are construed accordingly. The apparatus of the invention is not, of course limited to five segments of the first electrode layer 36. In principle any number of segments may be provided as necessary properly to simulate flames. For example, the first and second electrodes may be constructed as active or passive matrix electrodes (on suitable substrates) so that the segments 36A-E,N may be of pixel scale. Depending on the nature of the image (especially the flame image) which is desired, much larger segments 36A-E,N are possible and may be desirable. The control unit 24 includes necessary electronic hardware and software to control the excitation of segments 36A-E of the first electrode layer. Control unit 24 may be constructed to excite given segments of electrode layer 36 individually or in groups. For example, if excitation of a large area of electrode layer 36 is required, this may be achieved by simultaneous excitation of a number of adjacent segments which together comprise the desired large area.

Figure 2:
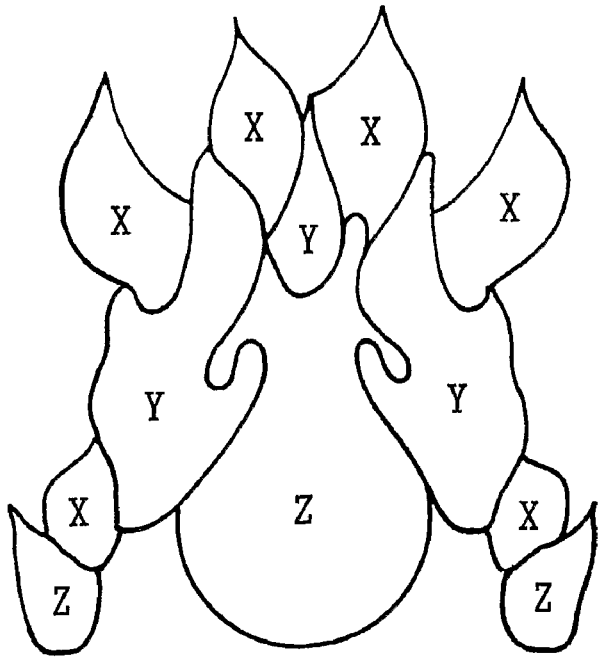
FIG. 2 is a typical arrangement on a flame-simulating screen according to the invention.

As can be seen from FIG. 2, in one embodiment, the electroluminescent screen 30 comprises a plurality of generally flame-shaped regions X, Y, Z. These regions X, Y, Z correspond to one or more of the first electrode layer segments 36A-E. Each region X, Y Z may equate to a single segment 36A-E of the first electrode layer, or to a number of such segments. The control unit 24 may be set up to excite the segments 36A-E underlying regions X, Y, Z in a predetermined sequence which may, for example, be random or pseudo-random. A pseudo-random sequence will appear to an observer to be random but is actually repeating over a period of time.

Layer 38 of electroluminescent material may also preferably be divided into segments or zones 38A, 38B, 38C, 38D and 38E. These zones may or may not correspond directly to segments 36A-E of the first electrode layer. For example, a given zone of the electroluminescent layer 38 may be excited by more than one segment of the first electrode layer. The zones 38A-E may comprise the same, or, where required, different, electroluminescent materials. For example, different materials may be used in adjacent zones to provide different flame colours. Flame colours will typically be largely yellows, reds and oranges, but other colours such as are know to occur in real flames may be included, in particular blues and greens. A given region X, Y, Z as shown in FIG. 2 may comprise more than one zone 38A-E, so that a given flame shape may comprise more than one colour, for example.

Thus, in this embodiment, to provide a flame effect, the control unit 24 excites in its predetermined sequence selected segments 36A-E of the first electrode layer. Excitation of these segments causes luminescence of the adjacent parts of the electroluminescent layer 38. For example, the sequence of excitation under the control of control unit 24 may be (a) excitation of all segments of the first electrode layer corresponding to regions X, (b) excitation of all segments of the first electrode layer corresponding to regions Y, (c) excitation of all segments of the first electrode layer corresponding to regions Z, (d) excitation of all segments of the first electrode layer corresponding to regions X and so on.

In an alternative embodiment, where the segments of the first electrode is or at or near conventional pixel size, the specific areas X, Y, Z are not necessary and the requisite flame shapes are produced by excitation of appropriate combinations of segments under the control of control unit 24. In this case, electroluminescent materials emitting in different colours may also preferably be arranged in the electroluminescent layer in areas which correspond with the segments 36A-E,N.

Figure 5:
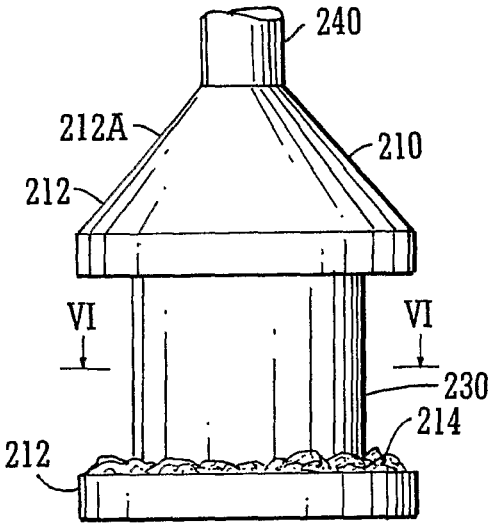
FIG. 5 shows an alternative construction of a simulated fire or stove according to the invention.
Figure 6:
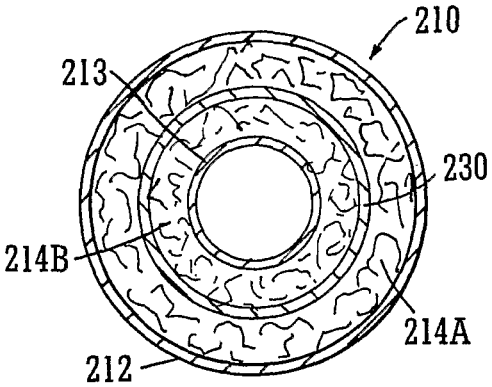
FIG. 6 is a cross section along line VI-VI of FIG. 5.

FIGS. 5 and 6 show another embodiment of a stove or fire 210 according to the invention. Whereas in the embodiments of FIGS. 1 and 3, the electroluminescent screens 30, 130 are essentially planar, in FIGS. 5 and 6 an electroluminescent screen 230 is provided which is generally cylindrical. Screen 230 is an electroluminescent flame-simulating arrangement which is equivalent in function and construction to the screens 30, 130, except that it is formed into a substantially cylindrical shape. By constructing the screen 230 in this way, it is possible to simulate the sort of real solid fuel fire or stove which is typically disposed in the middle of a room (or at least spaced from the walls), with its own chimney stack or flue 240 which rises to the roof. A user is able if desired to walk all around the stove 210 and view it from all angles. The stove 210 comprises a housing 212 in which the screen 230 is supported by any suitable means. The housing 212 also supports a fuel bed 214 which may comprise portions 214A and 214B respectively in front of and behind the screen 230. If screen 230 is made opaque, and optionally reflective, then fuel bed portion 214B is not necessary. The housing 212 may include an inner column 213 if necessary. Inner column 213 may be structural and provide support for upper housing portion 212A, if necessary. Alternatively the screen 230 may have sufficient strength to support housing portion 212A. The outer surface of column 213 may be coloured matt black or similar, so that its presence is not obvious to a user. Alternatively, the surface of the column 213 may be provided with a reflective or partially reflective finish to provide a reflection of the fuel bed 214 and so to increase a user's perception of the front-to-back depth of the fuel bed 214. Column 213 may also provide a location for mounting components of the stove 210, such as a control unit 24. The fuel bed 214 may be illuminated from below in a similar manner to fuel bed 14 of FIGS. 1 and 3, using one or more light sources 16 and one or more flicker devices 18.

Figure 7:
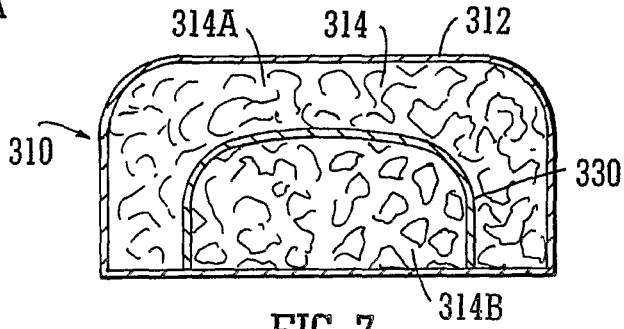
FIG. 7 shows a further alternative construction of a simulated stove or fire according to the invention.

FIG. 7 shows another embodiment of a stove or fire 310 according to the invention which is intended for mounting against a wall, such as in a fireplace or hearth. The fire 310 includes a curved electroluminescent screen 330 mounted in a housing 312. The housing 312 also supports a fuel bed 314 having portions 314A and 314B respectively in front of and behind the screen 330. Where, in a similar manner to FIG. 1, the front surface of screen 330 is made partially reflective fuel bed portion 314B may be absent. In this case also, the screen 330 need not be transparent.

Figure 8:
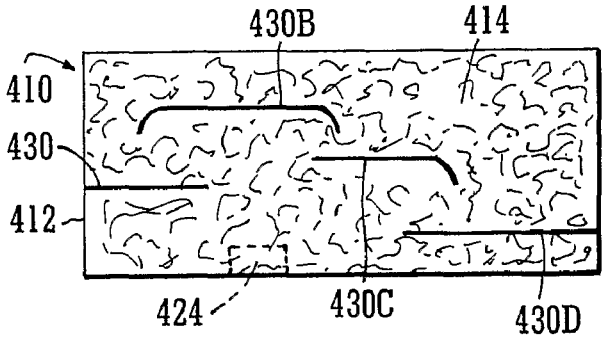
FIG. 8 shows a further alternative construction of a simulated stove or fire according to the invention including a plurality of screens.

In a further embodiment of the invention shown in FIG. 8, the fire 410 includes a housing 412 supporting a fuel bed 414. The housing 412 also supports a plurality of discrete electroluminescent screens 430A, 430B, 430C, 430D etc. The screens 430A-D may be straight and/or curved but are otherwise of generally the same construction as the screens 30, 130, 230, 330 of the above-described embodiments. The screens 430A-D are disposed at various locations with respect to the fuel bed 414, giving the illusion of flames appearing from different parts of the fuel bed. A control unit 424, indicated in ghost lines, mounted below the fuel bed 414 controls the sequence of illumination of each screen 430A-D and also the sequence of excitation of each segment 36A-E,N of the first electrode of the respective screens 430A-D. In alternative arrangement, one or more of screens 430A-D may be sized to represent a single flame and so may consist of a single zone 38A-E,N. Alternatively, each screen may have different segments 38A-E, preferably of different flame-like colours, to represent the true colours of a real flame.

Figure 14:
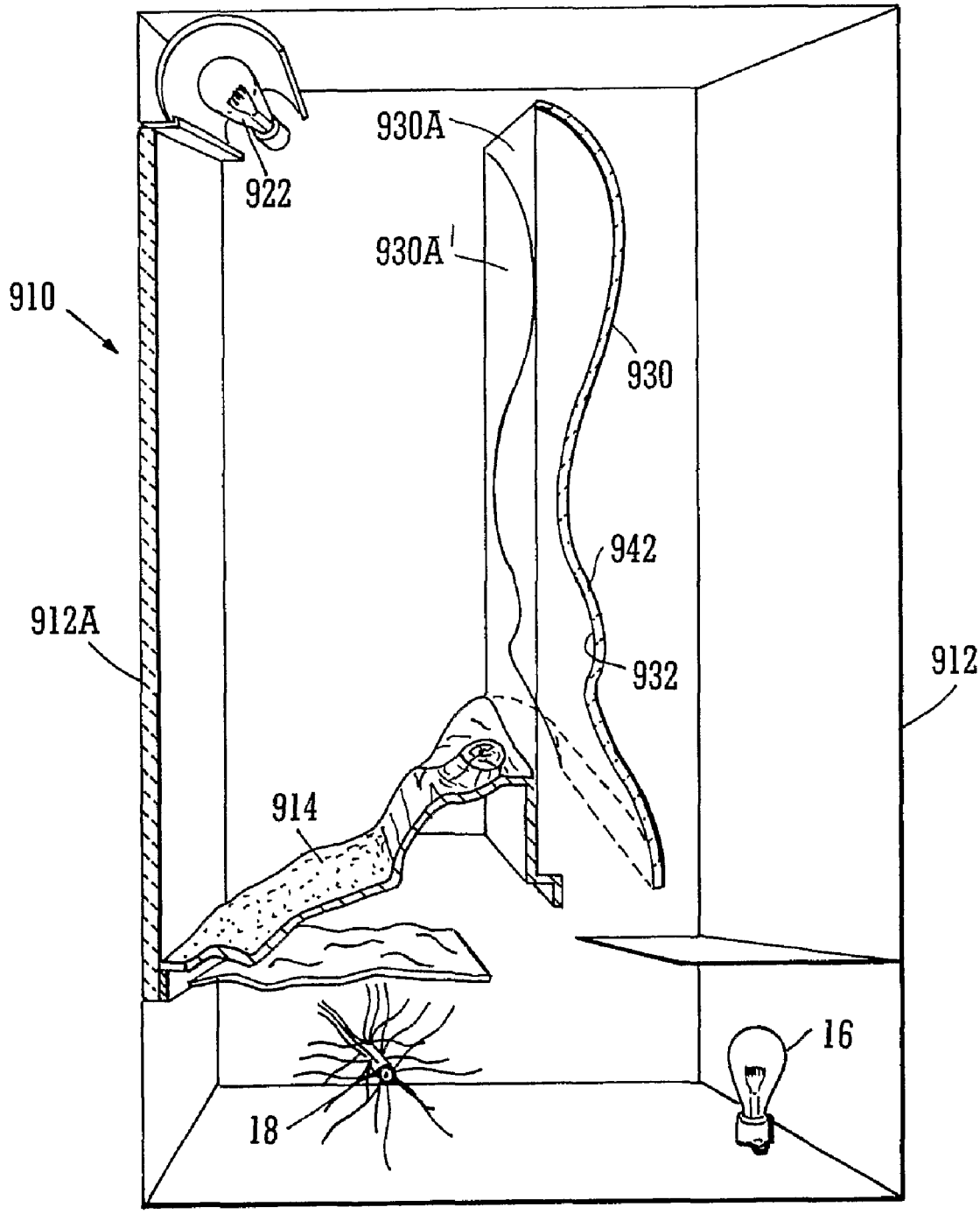
FIG. 14 shows a schematic cross-section showing the general arrangement of a fire similar to that of FIG. 4 including a non-planar electroluminescent screen.

FIG. 14 shows a flame simulating fire generally similar to that of FIG. 4. Similar components are given corresponding reference numbers, with the addition of the prefix "9". The fire of FIG. 14 includes an electroluminescent screen 930 which is non-planar. For example, the screen may comprises a supporting substrate 932 which is a shaped plastic moulding. In other respects the screen is generally of the same layer construction as screens 30, 130, 230, 330, 430. The non-planar construction of screen 930 enhances the three-dimensional appearance of the simulated flames. A screen 930A may be mounted in front of the screen 930. Screen 930A is transmissive of light from screen 930 and includes a reflective front surface 930A' by means of which a user sees a reflected image of fuel bed 914, so enhancing the perceived depth of fuel bed 914. In alternative arrangements, the screen 930A may be absent and fuel bed 914 may extend both in front of, and behind, screen 930. Screen 930 is merely illustrative of a non-planar screen and other non-planar shapes are possible, in accordance with a designer's wishes. In this respect, the electroluminescent laminate may be supplied in a flexible form which is attached to a shaped support such as a shaped plastic moulding. For example, layers 34 and 42 in FIG. 3 may be flexible plastic films, supporting the electrode and electroluminescent material layers.

Figure 9:
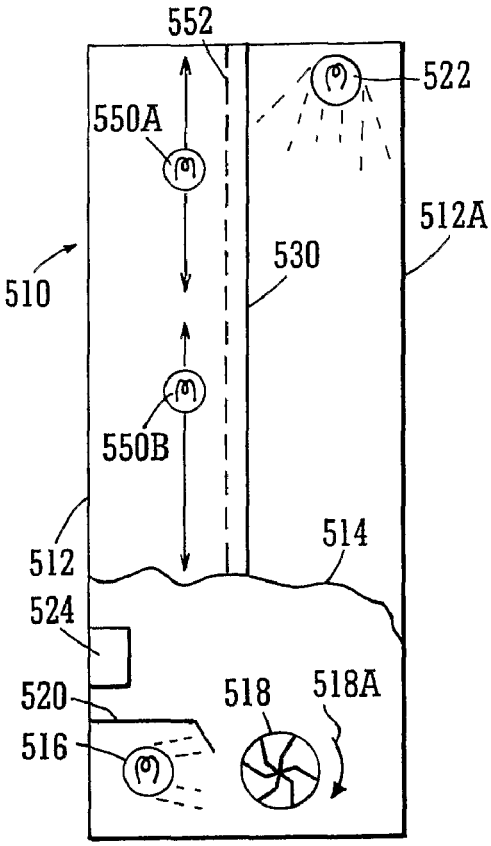
FIG. 9 is a schematic cross-section showing the general arrangement of a fire according to another embodiment of the invention.
Figure 10:
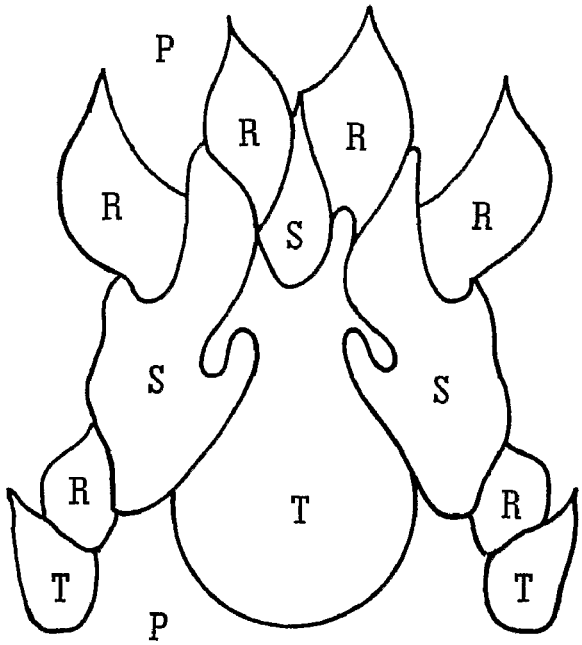
FIG. 10 is a typical arrangement on a flame-simulating screen according to the embodiment of FIG. 9.
Figure 11:
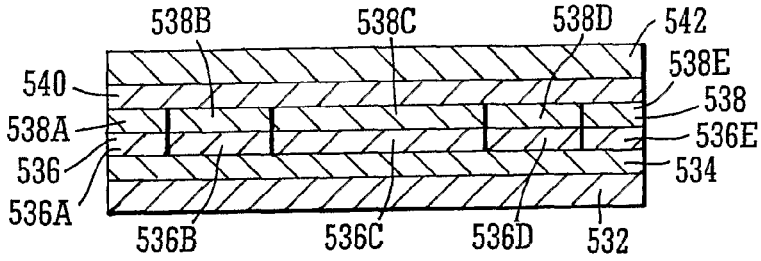
FIG. 11 shows a typical construction of a LCP or SPD screen according to the invention.

FIGS. 9, 10 and 11 illustrate an alternative embodiment of the invention. FIG. 9 shows in a general, non-limiting, arrangement a simulated fire 510 comprising a housing 512. The housing 512 may be constructed in any desired form to simulate the construction of a real solid fuel fire or stove and may optionally include a transparent front screen or window 512A. The housing 512 supports a simulated fuel bed 514. The fuel bed 514 may comprise a moulding formed from a plastic material, which is shaped and coloured to resemble pieces of fuel resting on an ember bed. For example, the moulding may represent logs (coloured primarily dark brown) resting on a bed of glowing embers (coloured primarily red and orange). In alternative constructions, the fuel bed may comprise an ember bed formed from a shaped and coloured plastic moulding, with discrete pieces of simulated fuel, such as logs or coals, resting on the ember bed. Fuel bed 514 may be illuminated from below by a light source 516. Light from the light source 516 may be reflected by a device 518 for providing a flicker effect which in the illustrated example is a shaft having generally radial pieces of reflective material. The shaft is rotated about its axis, as indicated by arrow 518A. A baffle 520 may be provided so that light from the light source 516 cannot fall on the fuel bed 514 other than via the flicker device 518. If desired, a light source 522 may be provided for illuminating the fuel bed from above.

For providing the flame effect to simulate the flames of a real fire, the simulated fire 510 of this embodiment is provided with a "suspended particle device" (SPD) or liquid crystal polymer (LCP) screen 530. SPDs are described, for example in U.S. Pat. No. 6,156,239 and in numerous other patents of Research Frontiers Inc, New York, USA. Preferred SPDs comprise a laminate in which the SPD material and associated electrodes are mounted on one or more polymeric films. The screen 530 comprises a supporting substrate 532 which is preferably substantially rigid and is fixedly mounted in the housing 512. A suitable supporting substrate 532 can be a glass sheet or a plastic sheet. A supporting layer 534 (which may be the same as supporting substrate 532 or may be a polymeric film) carries a first electrode layer 536. A layer of SPD or LCP material 538 is sandwiched between the first electrode layer 536 and a second electrode layer 540. Typical electrode layers 536, 540 are formed from materials such as indium tin oxide (ITO). A barrier substrate layer 542 is provided to enclose and protect the various layers below. Other layers may be included in the screen, as will be known to those skilled in the art of SPD and LCP materials. The barrier substrate and the second electrode layer are necessarily formed from transparent (or at least translucent) materials. The supporting substrate 532 and the supporting layer 534 are formed from transparent (or at least largely translucent) materials, at least in specific areas, as discussed below.

SPDs, which are sometimes known as "light valves", are currently used, for example, to provide windows of buildings with enhanced properties. SPDs have the property of being substantially opaque when no electric field is applied but become substantially transparent on application of an electric field. More specifically an SPD comprises a pair of electrodes (as noted above) between which is a plastic film in which molecular-scale rod-like particles are encapsulated in very many uniformly distributed cells. Each such cell contains many of the rod-like particles. With no applied voltage, the particles are randomly oriented and block light. When a voltage is applied (via the electrodes) the particles are caused to align with the electric field and so let light through. The degree of light transmission can be varied by varying the applied voltage. Thus the degree of opacity of the SPD can be varied. LCP screens behave similarly in that in the absence of an applied electric field the polymer molecules are randomly oriented and so block transmission of light. On application of an electric field, the LCP polymer molecules are aligned, allowing light to be transmitted. In contrast to SPDs, LCP devices have only transparent or opaque conditions, with no ability to vary the opacity. A typical LCP screen may be (but is not necessarily) white or a similar pale colour in the opaque condition. In either case (SPD or LCP), the "opaque" non-aligned state does not necessarily block the transmission of all light, but the transmission is reduced to an extent sufficient to render it difficult or substantially impossible to see through the screen 530.

In the present embodiment, the first electrode layer 536 is divided into discrete segments 536A, 536B, 536C, 536D, 536E, . . . 538N etc. which may be individually excited under the control of a control unit 524. Similarly the SPD or LCP layer 538 may be divided into segments or zones 538A-E etc., which may or may not correspond directly to segments 536A-E of first electrode layer 536. For example, a given zone 538N of the SPD or LCP layer 538 may be of larger area than segments of electrode layer 536 and so may be excited by more than one segment of the first electrode layer 536. Where, for example, the segment size of the first electrode layer 536 is sufficiently small, zones 538A-E, N are not required.

As can be seen from FIG. 10, the screen 530 comprises a plurality of generally flame-shaped regions R, S, T. These regions R, S, T correspond to one or more of the first electrode layer segments 536A-E. Each region R, S T may equate to a single segment 536A-E of the first electrode layer, or to a number of such segments. The control unit 524 may be set up to excite the segment(s) 536A-E underlying regions R, S, T in a predetermined sequence which may, for example, be random or pseudo-random. A pseudo-random sequence will appear to an observer to be random but is actually repeating over a period of time. In the alternative there are no fixed flame shaped regions X, Y, Z and the flame shapes are generated only by appropriate excitation of segments, or groups of segment 536A-E, N of the first electrode.

Thus, when a given segment 536N of first electrode 536 is excited, the area of the SPD layer adjacent that segment 536N becomes substantially transparent. In order to provide the appearance of flames, illumination is provided behind the screen 530, as shown schematically in FIG. 9 by light sources 550A and 550B. Light from the light sources 550A,B is transmitted at a maximum perceived intensity through a given area of the screen 530 only when a given area of the SPD or LCP layer 538 is made transparent by excitation of a particular segment or group of segments 536N of the first electrode 536. Given that even at its maximum opacity (no electric field), the SPD or LCD material may not be wholly opaque, some light from the light sources 550A,B may pass through the screen 530 whenever the light sources 550A,B are illuminated.

The light sources 550A, 550B may be selected from a range of possibilities. For example the light source 550A,B may comprise one or more conventional incandescent or halogen bulbs in a suitable location. In this case filters or coloured reflectors may be used to provide desired colours of light and reflectors and baffles may be provided to ensure that light falls in desired local regions of the screen 530. In alternative arrangements, specific individual light sources may be provided in register with a given specific local areas of the screen 530, such as a particular segment or group of segments 536N of the first electrode layer 536. These individual light sources can be of individually selected colours and intensities to provide an optimum simulated flame effect. In one preferred arrangement, the light sources comprise appropriately coloured LEDs or arrays of LEDs (more than one LED may be required to illuminate a given local area, segment or group of segments 536N). The use of LEDs allows the location, colour and intensity of the light sources to be tailored for optimum effect. If required, means 552 may be provided for diffusing the light from the light source(s) 550A,B. Such means may be an additional screen or screen layer which is inherently diffusing, such as a transparent plastic material doped with an opaque powder such as titanium dioxide, or a layer which has been made diffusing for example by abrasion of its surface. Alternatively, discrete areas of the screen 530 corresponding to regions R, S, T, or parts thereof, may be made diffusing. Regions P of the screen 530 outside the regions R, S, T may be permanently opaque. The front surface of screen 530 may be at least partially reflective to provide a reflected image of the fuel bed 514 and so to achieve the perception of flames appearing from the middle of the fuel bed.

Thus, in one embodiment of the invention, to provide a flame effect, the control unit 524 excites in its predetermined sequence selected segments 536A-E of the first electrode layer. Excitation of these segments causes the corresponding areas of layer 538, such as zones 538A-E, to become transparent. The control unit 24 may also preferably control selective illumination of the light sources 550A,B in accordance with the particular segments 536A-E which are excited at any given time.

For example, the sequence of excitation under the control of control unit 24 may be (a) excitation of all segments of the first electrode layer corresponding to regions R, (b) excitation of all segments of the first electrode layer corresponding to regions S, (c) excitation of all segments of the first electrode layer corresponding to regions T, (d) excitation of all segments of the first electrode layer corresponding to regions R and so on. As noted above, a given region R, S, T may comprise one or more segments of the first electrode layer 536. Thus, different areas of a given region R, S, T may be made transparent at different times, or the whole region R, S, T may be made transparent, and said different areas may exhibit different colours in accordance with the choice and particular arrangement of the light source or source 550A,B. Thus a very realistic flame effect may be achieved.

The above embodiment has been described in terms of an LCP/SPD screen 530 which is opaque when not subjected to an electric field and which is transparent when subjected to an electric field. Of course, the same result can be achieved by a screen which incorporates a layer which is transparent in the presence of an electric field and which becomes opaque in the absence of an electric field. In this context, the term "excite" in relation to the electrode layer 536 is interpreted to mean that the electric field is switch from an "on" state to an "off" state to result in a transparent zone 538N of the screen 536. The application and claims should be construed accordingly.

The control unit 24, 524 is arranged so that the various segments 36A-E,N or 536A-E,N are excited in a sequence and timing so that the user's eye always perceives flames to be present, in one location or another. Also, the control unit 24, 524 may optionally be programmed so that a user may select from a range of parameters for the simulated fire, such as the speed of change of the flames, or the intensity of the light emitted.

Figure 12:
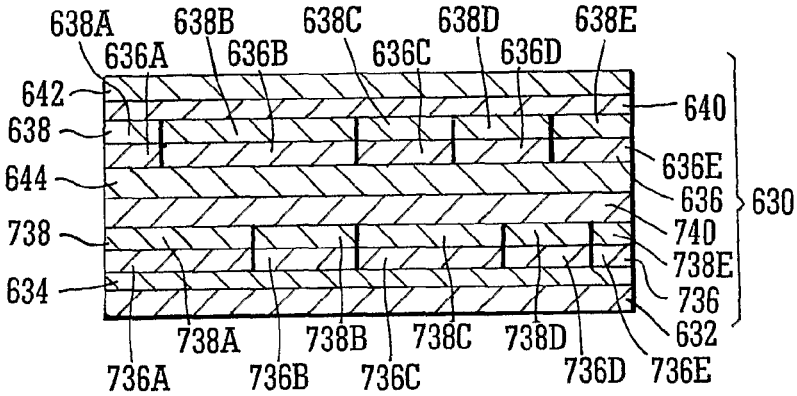
FIG. 12 shows a typical construction of an electroluminescent and LCP/SPDscreen according to the invention.

The present invention also relates to a simulated flame effect fire which includes a screen 630 which includes both an electroluminescent layer 738 and an LCD or SPD layer 638, as illustrated in FIG. 12. The screen 630 includes first and second electrodes 636, 640 associated with the LCD or SPD layer 638 and first and second electrodes 736, 740 associated with the electroluminescent layer 738. Screen 630 also includes a supporting substrate 632, a supporting layer 634 (which may be the same as supporting substrate 632), a barrier substrate layer 642 and a separating layer 644. In the same manner as described in relation to the embodiments above, the respective first electrodes 736, 636 may be divided into discrete segments 736A-E,N and 636A-E,N which are individually excitable by a control unit (not illustrated) and likewise electroluminescent layer 738 and SPD/LCP layer 638 may optionally be divided into zones 738A-E and 638A-E,N respectively. In this way, even though a given zone, say 738N, of electroluminescent layer 738 is caused to be luminescent by excitation of corresponding segment, say 736N of first electrode 736, a part (or even, for a given time, all) of the zone 738N may be obscured as a corresponding zone 638N of SPD/LCD layer 638 is caused to be opaque. Thus an enhanced degree of variation in the flame simulating effect is achieved.

Figure 13:
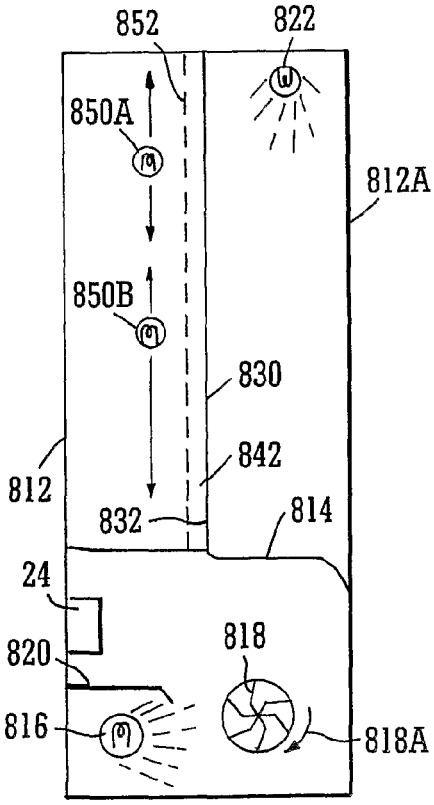
FIG. 13 is a schematic cross-section showing the general arrangement of a fire according to another embodiment of the invention.

FIG. 13 shows a simulated flame effect similar in construction to the fire of FIG. 4 and like components have like numbers with the addition of the prefix "8". Screen 830 corresponds to screen 130 and need not be transparent but should be translucent. Thus, for example, first electrode layer 36, or any other layer lying behind electroluminescent layer 38 (with respect to a user) is preferably translucent. To supplement or enhance the light emitted by electroluminescent layer 38, additional light sources 850A, 850B are provided. Thus, when a given segment 36N of first electrode 36 is excited, the area of the zone electroluminescent layer 38 adjacent that segment 36N becomes emits light. Light from the light sources 850A,B is transmitted through the screen 830 in addition to light emitted by electroluminescent layer 38. SPD or LCD layers and corresponding first and second electrodes may be provided so that light from the light sources 850A,B is transmitted through the screen 830 only where a given zone of the SPD or LCP layer, corresponding to luminescing zone 36N, is made transparent.

The light sources 850A, 850B may be selected from a range of possibilities. For example the light source 850A,B may comprise one or more conventional incandescent or halogen bulbs in a suitable location. In this case filters or coloured reflectors may be used to provide desired colours of light and reflectors and baffles may be provided to ensure that light falls in desired local regions of the screen 830. In alternative arrangements, specific individual light sources may be provided in register with a given specific segment or group of segments 36N of the first electrode layer 36. These individual light sources can be of individually selected colours and intensities to provide an optimum simulated flame effect. For example, a light source of a particular colour can be chosen to modify and enhance, in the user's perception, the colour of light emitted by a given zone 36N of luminescent layer 36. In one preferred arrangement, the light sources comprise appropriately coloured LEDs or arrays of LEDs (more than one LED may be required to illuminate a given segment or group of segments 36N). The use of LEDs allows the location, colour and intensity of the light sources to be tailored for optimum effect. If required, means 852 may be provided for diffusing the light from the light source(s) 850A,B. Such means may be an additional screen or screen layer which is inherently diffusing, such as a transparent plastic material doped with an opaque powder such as titanium dioxide, or a layer which has been made diffusing for example by abrasion of its surface. Alternatively, discrete areas of the screen 830 corresponding to regions X, Y, Z, or parts thereof, as in FIG. 2 may be made diffusing. Regions of the screen 830 outside the regions X, Y, Z may be permanently opaque. The front surface of screen 830 may be at least partially reflective to provide a reflected image of the fuel bed 814 and so to achieve the perception of flames appearing from the middle of the fuel bed.

Thus, to provide a flame effect, the control unit 24 excites in its predetermined sequence selected segments 36A-E of the first electrode layer. Excitation of these segments causes the corresponding areas, such as zones 38A-E, of the electroluminescent layer to emit light. If present, corresponding zones of an SPD/LCD become transparent by excitation of their corresponding first electrode segment. The control unit 24 may preferably also control selective illumination of the light sources 850A,B in accordance with the particular segments 36A-E which are excited at any given time.

For example, the sequence of excitation under the control of control unit 24 may be (a) excitation of all segments of the first electrode layer corresponding to regions X, (b) excitation of all segments of the first electrode layer corresponding to regions Y, (c) excitation of all segments of the first electrode layer corresponding to regions Z, (d) excitation of all segments of the first electrode layer corresponding to regions X and so on. As noted above, a given region X, Y, Z may comprise one or more segments of the first electrode layer 36. Thus, different areas of a given region X, Y, Z may be caused to emit light at different times, or the whole region X, Y, Z may be caused to emit light, and said different areas may exhibit different colours in accordance with the choice and particular arrangement of the light source or source 850A,B and the particular electroluminescent materials. Thus a very realistic flame effect may be achieved. Where a diffusing element as indicated at 852 is present, the screen 830 may not require an LCP/SPD device, as selective control of the illumination of the light sources, which are then preferably small light sources such as LEDs in register with specific local regions of the screen, is sufficient to achieve a satisfactory flame effect in conjunction with selective excitation of the zones of the electroluminescent layer.

The control unit 24, 524 is arranged so that the various segments 36A-E or 536A-E are excited in a sequence and timing so that the user's eye always perceives flames to be present, in one location or another. Also, the control unit 24, 524 may optionally be programmed so that a user may select from a range of parameters for the simulated fire, such as the speed of change of the flames, or the intensity of the light emitted When the simulated flame effect fire of the invention is not in use, the screen, 530, 630 is opaque and, preferably, of a dark colour. Screens 30, 130, 230, 330, 430 can be made opaque by addition of an LCP or SPD device. A pleasing unobtrusive effect is thereby obtained. Where the simulated flame effect fire includes a front screen such as 12A in FIG. 1, that too can be constructed as an LCP or SPD screen which is transparent when the fire is in use and opaque when the fire is not in use.

An advantage of screens 30, 130, 230, 330 430, 530 is that they are very thin, typically 10 mm or less. Thus the simulated fires constructed in accordance with the invention may be made to have a very small front to back dimension and as such may are suitable for direct mounting on a plane wall. In other words a hearth or chimney is not needed. This is advantageous when the simulated fire is to be installed in a house of modern construction, an apartment or the like.

In an advantageous embodiment, the apparatus and simulated flame effect fires of the invention may be provided with an additional electroluminescent screen, or with an additional electroluminescent material and associated electrodes on the screen 30, 130, 230, 330, 430, 530, 830, 930 which is arranged to provide an aesthetically pleasing image or pattern, different from the simulated flame effect, when the flame effect is turned off. In an alternative variation, where the screen is transparent, an image or picture may be located behind the screen so that when the electroluminescent flame effect is not required, the picture is visible.

Whereas the devices described in relation to the present invention have been described in relation to flame effect fires, other effects are possible and are within the scope of the invention. For example the constructions described herein may be used simply to provide an aesthetically pleasing effect of changing light patterns which may or may not resemble flames. The fuel bed 14, 114, 214, 314, 414, 514 may be replaced with another aesthetically pleasing construction, such as a bed of coloured or colourless glass or plastic beads, a bed of real or simulated pebbles and the like.

The simulated flame effect fires according to the invention may or may not be provided with a heat source. A typical heat source is a fan heater mounted within housing 12, 212, 312, 412, 512 which expels a current of heated air. Radiant heaters may also be employed. However, many residences, offices, hotels and so on are now centrally heated so that additional heating is no longer required. Thus the flame effect fire of the invention may be used, for example to provide an attractive focal point in a room, with any heat source being necessary.

The use of an SPD or LCP screen may also be adapted to the types of simulated fire construction illustrated in FIGS. 5, 6 and 7 which employ curved screens.

The invention claimed is:

1. A simulated flame effect fire comprising:

a housing;

an electroluminescent screen comprising a supporting substrate, a first electrode layer, a layer comprising at least one electroluminescent material, and a second electrode layer, wherein the first electrode layer is divided into separately excitable segments, each segment causing an adjacent portion of the electroluminescent layer to emit light when said segment is excited;

a control unit operative sequentially to excite segments or groups of segments of said first electrode layer having a shape resembling that of flames in a predetermined, random or pseudo-random sequence, and a simulated fuel bed wherein said electroluminescent screen extends upwardly from the simulated fuel bed.

2. A simulated flame fire as claimed in claim 1 comprising distinct areas of the electroluminescent material layer which are shaped to be representative of flames each said area including one or more electroluminescent materials emitting light of flame like colours.

3. A simulated flame effect fire as claimed in claim 1 including a plurality of said electroluminescent screens.

4. A simulated flame effect fire as claimed in claim 1 further comprising one or more light sources effective to illuminate local areas of the electroluminescent screen.

5. A simulated flame effect fire as claimed in claim 4 wherein said light source or light sources illuminate said electroluminescent screen from the rear.

6. A simulated flame effect fire as claimed in claim 4 wherein said light sources comprise individual LEDs or groups or arrays of LEDs.

7. A simulated flame effect fire comprising:

a housing;

a screen including means for providing a variable opacity comprising a supporting substrate, a first electrode layer, a layer of material for providing a variable opacity when subjected to an electric field, and a second electrode layer, wherein the first electrode layer is divided into separately excitable segments, each segment causing an adjacent portion of the layer of material for providing a variable opacity to change its opacity when said segment is excited;

one or more light sources effective to illuminate local areas of the said screen;

a control unit operative sequentially to excite segments or groups of segments of said first electrode layer having a shape resembling that of flames in a predetermined, random or pseudo-random sequence, and a simulated fuel bed wherein said screen extends upwardly from the simulated fuel bed.

8. A simulated flame effect fire as claimed in claim 7 wherein the layer of material for providing a variable opacity is divided into distinct areas of predetermined shape.

9. A simulated flame effect fire as claimed in claim 8 wherein said distinct areas of the layer of material for providing a variable opacity are shaped to be representative of flames and wherein said light source or light sources are adapted to provide light of flame like colours.

10. A simulated flame effect fire as claimed in claim 7 wherein said light source or light sources illuminate said screen from the rear.

11. A simulated flame effect fire as claimed in claim 10 wherein said light sources comprise individual LEDs or groups or arrays of LEDs.

12. A simulated flame fire as claimed in claim 10 wherein said light source or light sources are adapted to provide light of flame like colours.

13. A simulated flame effect fire as claimed in claim 7 wherein the means for providing a variable opacity is a liquid crystal polymer (LCP) device or a suspended particle device (SPD).

14. A simulated flame effect fire comprising:

a housing;

a screen comprising:

a supporting substrate; a first electrode layer; a layer of electroluminescent material; and a second electrode layer; wherein the first electrode layer is divided into separately excitable segments, each segment causing an adjacent portion of the electroluminescent layer to emit light when said segment is excited; a third electrode layer; a layer of material for providing a variable opacity when subjected to an electric field; and a fourth electrode layer, wherein the third electrode layer is divided into separately excitable segments, each segment causing an adjacent portion of the layer of material for providing a variable opacity to change its opacity when said segment is excited; and a control unit operative sequentially to excite segments or groups of segments of said first and/or third electrode layer having a shape resembling that of flames in a predetermined, random or pseudo-random sequence.

15. A simulated flame fire as claimed in claim 14 comprising distinct areas of the electroluminescent material layer which are shaped to be representative of flames each said area including one or more electroluminescent materials emitting light of flame like colours.

16. A simulated flame effect fire as claimed in claim 14 wherein the layer of material for providing a variable opacity is divided into distinct areas of predetermined shape.

17. A simulated flame fire comprising an apparatus as claimed in claim 16 wherein said distinct areas of the layer of material for providing a variable opacity are shaped to be representative of flames.

18. A simulated flame effect fire as claimed in claim 14 further comprising one or more light sources effective to illuminate local areas of said screen.

19. A simulated flame effect fire as claimed in claim 14 further comprising a simulated fuel bed mounted in said housing directly below said screen.

* * * * *